US005970954A

United States Patent [19]

Worth et al.

[11] Patent Number: 5,970,954

[45] Date of Patent: Oct. 26, 1999

[54] CONTROL OF FUELING OF AN INTERNAL COMBUSTION ENGINE

[75] Inventors: David Richard Worth, Shenton Park; Richard William Hurley, Glen Waverley; Keith Melbourne, Mount Hawthorn, all of Australia

[73] Assignee: Orbital Engine Company (Australia) Pty Limited, Balcatta, Australia

[21] Appl. No.: 09/051,806

[22] PCT Filed: Dec. 13, 1996

[86] PCT No.: PCT/AU96/00808

§ 371 Date: Apr. 23, 1998

§ 102(e) Date: Apr. 23, 1998

[87] PCT Pub. No.: WO97/22790

PCT Pub. Date: Jun. 26, 1997

[30] Foreign Application Priority Data

Dec. 15, 1995 [AU] Australia ..... 7167

[51] Int. Cl.[6] ..... F02M 51/00

[52] U.S. Cl. ..... 123/478; 123/492

[58] Field of Search ..... 123/478, 492, 123/493

[56] References Cited

U.S. PATENT DOCUMENTS

| | | | |
|---|---|---|---|
| 4,401,080 | 8/1983 | Otsuka et al. | 123/492 |
| 4,469,073 | 9/1984 | Kobayashi et al. | 123/492 |
| 4,561,405 | 12/1985 | Simons | 123/492 |
| 4,721,083 | 1/1988 | Hosaka | 123/493 |
| 4,852,538 | 8/1989 | Nagaishi | 123/493 |
| 5,901,682 | 5/1999 | Mcgee et al. | 123/339.19 |

FOREIGN PATENT DOCUMENTS

| | | |
|---|---|---|
| 0 153 012 A2 | 3/1985 | European Pat. Off. . |
| 0 643 210 A1 | 9/1993 | European Pat. Off. . |

OTHER PUBLICATIONS

Patent Abstracts of Japan, M–680, p. 97, JP, A, 62–233437 (Mazda Motor Corp) Sep. 13, 1987.

Patent Abstracts of Japan, M–1141, p. 11, JP,A, 3–107561 (Hitachi Ltd) May 7, 1991.

*Primary Examiner*—Erick R. Solis
*Attorney, Agent, or Firm*—Nikaido, Marmelstein, Murray & Oram LLP

[57] ABSTRACT

A method for controlling fuel supply to an engine, having idle and off-idle operating modes, including determining the total fuel per cycle at idle ($FPC_{TOTAL\text{-}IDLE}$); determining the total fuel per cycle off-idle ($FPC_{TOTAL\ OFF\text{-}IDLE}$); comparing ($FPC_{TOTAL\ OFF\text{-}IDLE}$) with ($FPC_{TOTAL\ OFF\text{-}IDLE}$); wherein if ($FPC_{TOTAL\ OFF\text{-}IDLE}$) is less than ($FPC_{TOTAL\text{-}IDLE}$), a control means determines a fueling level to the engine at least greater than ($FPC_{TOTAL\ OFF\text{-}IDLE}$).

23 Claims, 1 Drawing Sheet

CONTROL OF FUELING OF AN INTERNAL COMBUSTION ENGINE

This invention relates to the control of fuelling to an engine and, more particularly, to a method of control of fuelling to an engine when in transition from an idle to an off-idle condition of operation.

There is known from the Applicant's Australian Patent Application No. 34862/93 a fuel based control system for an engine. In such a system, the fuel per cylinder per cycle (FPC) is set as a function of operator demand as measured, for example, by sensed throttle pedal position and engine speed. The fuelling level set in response to operator demand may be characterised as $FPC_{DEMAND}$ and may be variable. The engine management system employed for the fuel based control strategy also determines a fuel per cycle amount applicable to idle conditions. This fuelling level is typically determined from the output of a conventional closed loop idle control strategy in the known manner together with an idle demand input which may be characterised overall as $FPC_{IDLE}$. Hence, there are definable operating conditions being idle operation and off-idle or operator demand operation.

In addition to the FPC components described above, offsets to FPC may be provided. These offsets may characteristically be additional amounts of fuel for when, for example, the engine is cold and frictional forces will be larger than during normal operation, or which relate to situations such as when additional engine loads are present, for example, when an air-conditioner is activated.

The total FPC to the engine, being the actual amount of fuel delivered to the engine, may then be established by the following formulae which: would apply for different operating conditions:

Off idle: $FPC_{TOTAL\text{-}OFF\ IDLE}=FPC_{DEMAND}+FPC_{OFFSETS}$.

At idle: $FPC_{TOTAL\text{-}IDLE}=FPC_{IDLE\ DEMAND}$ (from idle FPC map)+ $FPC_{IDLE}$ (from PID controller)+$FPC_{OFFSETS}$.

When the engine is operating in an idle condition, there will not be any operator demand on the engine, however, a base idle fuelling value ($FPC_{IDLE\ DEMAND}$) is provided from an idle FPC map to which a further FPC value as determined by an idle or PID controller is added ($FPC_{IDLE}$).

As all engines have different friction levels associated therewith, $FPC_{TOTAL}$ for a particular idle speed (i.e $FPC_{TOTAL\text{-}IDLE}$) can vary from engine to engine as a function of such friction. Further, $FPC_{TOTAL\text{-}IDLE}$ may also vary on the basis of previous operating conditions. As an example, $FPC_{TOTAL\text{-}IDLE}$ may be lower for an engine which has been operating for a certain period of time and hence is warm as compared to an engine which has just been started. Still further, other engine specific and application specific factors may result in some engine to engine variation of $FPC_{TOTAL\text{-}IDLE}$. For example, in the case of marine engines, the type and pitch of the propeller used will have an effect on $FPC_{TOTAL\text{-}IDLE}$. This latter case may be quite significant as in such marine applications it is possible to be at idle in neutral or at idle whilst in gear. Hence the $FPC_{TOTAL\text{-}IDLE}$ could be quite different for each situation. Accordingly, a problem may arise on leaving idle and moving to an off-idle operating condition, for example, when engaging a gear and applying some operator demand in a marine application.

On leaving idle, a condition may arise wherein the new fuelling level determined by the engine management system, $FPC_{TOTAL\ OFF\text{-}IDLE}$. may be below the previous $FPC_{TOTAL\text{-}IDLE}$ value causing a loss in speed of the engine and possible stalling which is undesirable.

It is the object of the present invention to provide a method of control of fuelling to an engine that substantially reduces or eliminates any loss or drop in engine speed during the transition between fuelling at idle and fuelling off-idle.

With this object in view, the present invention provides a method of control of fuelling to an engine in transition between idle and off-idle operating modes including;

determining the total fuel per cycle at idle ($FPC_{TOTAL\text{-}IDLE}$);

determining the total fuel per cycle off-idle ($FPC_{TOTAL\text{-}OFF\ IDLE}$);

comparing $FPC_{TOTAL\text{-}IDLE}$ with $FPC_{TOTAL\text{-}OFF\ IDLE}$;

wherein, if $FPC_{TOTAL\text{-}OFF\ IDLE}$ is less than $FPC_{TOTAL\text{-}IDLE}$, a control means determines a fuelling level to the engine at least greater than $FPC_{TOTAL\ OFF\text{-}IDLE}$.

Preferably, the control means determines a fuelling level to the engine by incrementing $FPC_{TOTAL\text{-}OFF\ IDLE}$ by a controlled value $FPC_{INC}$. Conveniently, $FPC_{TOTAL\text{-}OFF\ IDLE}$ is incremented before the engine leaves the idle operating mode.

Preferably, the method of control of fuelling is employed in the case where a transition from an idle operating mode to an off-idle operating mode occurs. Such a transition is typical of acceleration or the application of some operator demand from idle.

The value of $FPC_{INC}$ may be determined or controlled in a number of ways. Conveniently, $FPC_{TOTAL\text{-}OFF\ IDLE}$ is set in response to operator demand ($FPC_{DEMAND}$), for example, as measured by throttle position. $FPC_{TOTAL\text{-}OFF\ IDLE}$ may also take account of any fuel per cycle offsets ($FPC_{OFFSETS}$) relating to necessary or desired additional amounts of fuel compensating for particular operating conditions or applications. For example, allowance may be made for the operation of a device loading the engine, for example an air conditioner. This may not necessarily include additional fuel due to transients such as those caused by gear-shifting. In this regard, it would then be the case that prior to or during a transition from idle to off-idle that $FPC_{DEMAND}$ plus any $FPC_{OFFSETS}$ (=$FPC_{TOTAL\text{-}OFFIDLE}$) is compared with the $FPC_{TOTAL\text{-}IDLE}$ to establish the necessary subsequent fuelling level to the engine.

BRIEF DESCRIPTION OF THE FIGURE

A description follows of various implementations of the method, the description being made with reference to FIG. 1 which provides an $FPC_{TOTAL}$-engine speed/throttle position characteristic for the following implementations:

(*a*) is a characteristic where $FPC_{TOTAL\text{-}OFF\ IDLE}$ is dictated by $FPC_{DEMAND}$ maps;

Figure 1:
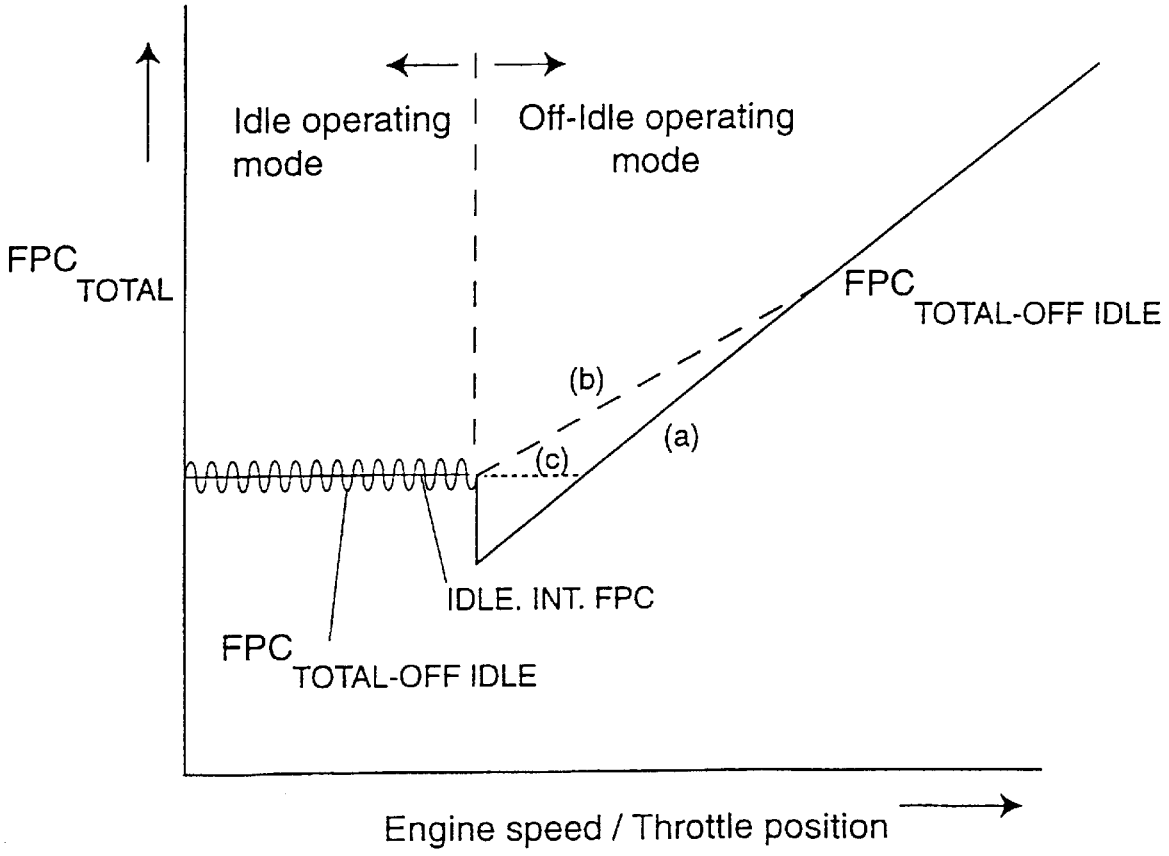

(*b*) shows the effect of incrementing $FPC_{TOTAL\text{-}OFF\ IDLE}$ by $FPC_{INC}$ and blending this into the FPC demand map; and (*c*) shows the case (i) where $FPC_{TOTAL\text{-}OFF\ IDLE}$ is set at $FPC_{TOTAL\text{-}IDLE}$ until $FPC_{TOTAL\text{-}OFF\ IDLE}$ becomes greater than $FPC_{TOTAL\text{-}IDLE}$; or case (ii) where $FPC_{TOTAL\text{-}OFF\ IDLE}$ is incremented by $FPC_{INC}$ until $FPC_{TOTAL\text{-}OFF\ IDLE}$ is greater than $FPC_{TOTAL\text{-}IDLE}$.

Thus, in a preferred embodiment, $FPC_{INC}$ may be set as the difference or a percentage of the difference between actual $FPC_{TOTAL\text{-}IDLE}$ and $FPC_{DEMAND}$ plus $FPC_{OFFSETS}$ ($FPC_{TOTAL\text{-}OFF\ IDLE}$). Hence, when coming out of idle and into off-idle operating mode, the fuelling level to the engine will be $FPC_{TOTAL\text{-}OFF\ IDLE}$ plus $FPC_{INC}$ and will be greater than $FPC_{TOTAL\text{-}OFF\ IDLE}$ as originally determined. Conveniently, $FPC_{TOTAL\text{-}OFF\ IDLE}$ plus $FPC_{INC}$ will be at least equal to or greater than $FPC_{TOTAL\text{-}IDLE}$.

Preferably, $FPC_{INC}$ may be decremented in a ramp or step-wise manner based on increasing throttle position or engine speed. That is, $FPC_{INC}$ is continually decremented such that the fuelling level to the engine will eventually return to being determined solely by $FPC_{TOTAL\text{-}OFF\ IDLE}$ and $FPC_{INC}$ will reduce to zero. This method has the advantage of maintaining the feel of linearity of the increase in operator demand.

$FPC_{TOTAL\text{-}OFF\ IDLE}$ may, in the main, be calculated by a normal look-up table or map as is known from the prior art. Typical ordinates of such an FPC map may be throttle position and engine speed. $FPC_{TOTAL\text{-}IDLE}$ may be in part dependent on a look-up map. Such a look-up map may conveniently only be dependent upon engine speed or coolant temperature. This look-up map may provide a base idle fuelling rate ($FPC_{IDLE\ DEMAND}$) which together with any additional fuelling determined by a PID idle controller ($FPC_{IDLE}$) and due to any offsets ($FPC_{OFFSETS}$) determines the overall idle fuelling level ($FPC_{TOTAL\text{-}IDLE}$).

Hence, in regard to the preferred embodiment as alluded to hereinbefore, the difference, or percentage of the difference, between $FPC_{TOTAL\text{-}OFF\ IDLE}$ and $FPC_{DEMAND}$ ($FPC_{INC}$) may be decremented, for example in accordance with a measured engine operating condition such as engine speed or derivatives thereof or other factors such as throttle position such that the fuelling level to the engine when operating in the off-idle operating mode, $FPC_{TOTAL\ OFF\text{-}IDLE}$, approaches the value of $FPC_{DEMAND}$ plus $FPC_{OFFSETS}$ output from the look-up map. That is $FPC_{INC}$ approaches zero such that the fuelling level to the engine is blended back into the normal $FPC_{DEMAND}$ look-up map. The decrementing routine or algorithm may be set in a number of ways.

However, as $FPC_{INC}$ may itself include allowance for $FPC_{OFFSETS}$, for example, to allow for engine friction especially at cold-start, though $FPC_{INC}$ may be adapted with engine operating conditions, including engine speed and/or time, it is possible for $FPC_{INC}$ to maintain a positive value over the whole $FPC_{DEMAND}$ map.

In an alternative embodiment, where the comparison between $FPC_{TOTAL\text{-}IDLE}$ and $FPC_{TOTAL\text{-}OFF\ IDLE}$ determines that $FPC_{TOTAL\text{-}OFF\ IDLE}$ is less than $FPC_{TOTAL\text{-}IDLE}$ the fuelling level to the engine as determined by the control means may be set at least equal to $FPC_{TOTAL\text{-}IDLE}$ until subsequent movement of the throttle is sufficient to provide an $FPC_{TOTAL\text{-}OFF\ IDLE}$ greater than $FPC_{TOTAL\text{-}IDLE}$. That is, if upon the engine coming out of idle, the $FPC_{TOTAL}$ value is less than at idle, the control means ensures that the $FPC_{TOTAL\text{-}OFF\ IDLE}$ value remains at least equal to the previous $FPC_{TOTAL\text{-}IDLE}$ value (referring to FIG. 1(*c*)) until the operator demands an $FPC_{TOTAL}$ value that is greater than the previous $FPC_{TOTAL\text{-}IDLE}$ value. In one embodiment, this may simply be achieved by having the idle or PID controller control the FPC to a value equal to $FPC_{TOTAL\text{-}IDLE}$ until $FPC_{TOTAL\text{-}OFF\ ,IDLE}$ exceeds this value. Hence, the engine essentially remains in idle mode for a slightly longer period.

Conveniently, the method of control of fuelling of the present invention is implemented on a fuel based control system such as that disclosed in the Applicant's Australian Patent Application No. 34862/93.

The operator demand and hence $FPC_{DEMAND}$ may conveniently be determined as a function of throttle position. Such throttle position may for example be determined by way of an appropriate throttle position sensor of a marine, vehicle or other engine application or by way of a pedal potentiometer on an accelerator pedal of a vehicle.

The strategy may equally be employed on deceleration. If the operator decelerates to a point where $FPC_{TOTAL\text{-}OFF\ IDLE}$ is less than $FPC_{TOTAL\text{-}IDLE}$ determined from the previous idle condition, then the fuelling level set for the engine by the engine management system or control means may be maintained at a value at least equal to $FPC_{TOTAL\text{-}IDLE}$ until a true idle condition is correctly established wherein, for example, a closed loop idle control strategy determines a new $FPC_{TOTAL\text{-}IDLE}$ and hence the idle speed of the engine.

One mode of operation for the control means which determines whether $FPC_{TOTAL\text{-}IDLE}$ or $FPC_{TOTAL\text{-}OFF\ IDLE}$ or $FPC_{TOTAL\text{-}OFF\ IDLE}$ plus $FPC_{INC}$ should be the fuelling level for the engine when it moves out of idle and into off-idle operating mode involves integrating $FPC_{TOTAL\text{-}IDLE}$. Due to the operation of the idle PID controller determining values for $FPC_{IDLE}$on top of $FPC_{IDLE\ DEMAND}$ as determined from the idle FPC map, the $FPC_{TOTAL\text{-}IDLE}$ value may vary within a certain significant range (see FIG. 1). Hence it may be desired to average the fuelling level during idle operation such that it is this averaged FPC value that is compared with $FPC_{TOTAL\text{-}OFF\ IDLE}$ when the engine moves from idle to off-idle operating mode. Accordingly, the off-idle fuelling level to the engine will be at least equal to this averaged $FPC_{TOTAL\text{-}IDLE}$ value or will at least be an acceptable value in the range between this averaged $FPC_{TOTAL\text{-}IDLE}$ and $FPC_{TOTAL\text{-}OFF\ IDLE}$ (i.e $FPC_{TOTAL\text{-}OFF\ IDLE}$+$FPC_{INC}$) depending upon which embodiment of the present method is implemented to avoid an undesirable drop off in engine speed on leaving idle operating mode.

When employed, the integral of $FPC_{TOTAL\text{-}IDLE}$ (IDLE.INT.FPC), may typically be some form of moving average value with a minimum number of samples. On moving off-idle and hence entering the normal FPC look-up maps to determine the fuelling level to the engine, $FPC_{TOTAL\text{-}OFF\ IDLE}$ is controlled to be not less than the initial $FPC_{TOTAL\text{-}OFF\ IDLE}$ value as determined in the main from the $FPC_{DEMAND}$ look-up map plus the difference, or a percentage of the difference, between the initial $FPC_{TOTAL\text{-}OFF\ IDLE}$ and IDLE.INT.FPC ($FPC_{INC}$). (referring to FIG. 1(*b*)). Alternatively, IDLE.INT.FPC may itself be selected as the fuelling level on moving off-idle until $FPC_{TOTAL\text{-}OFF\ IDLE}$ exceeds IDLE.INT.FPC beyond which the idle or PID controller no longer determines the engine FPC(referring to FIG. 1(*c*)). The latter situation pertains where $FPC_{TOTAL\text{-}OFF\ IDLE}$ is less than $FPC_{TOTAL\text{-}IDLE}$ as reflected by the averaged value IDLE.INT.FPC. In regard to this latter situation, as the operator demand subsequently increases and hence the throttle position is advanced such that the engine management system is stepping through the demand FPC look-up map values in the known manner, there will come a point where $FPC_{TOTAL\text{-}OFF\ IDLE}$ will be greater than IDLE.INT-.FPC. Accordingly, from this point onwards, $FPC_{TOTAL\text{-}OFF\ IDLE}$ is used as the fuelling level for the engine.

In regard to the former situation, $FPC_{INC}$ is reduced as the operator demand subsequently increases to the point where $FPC_{INC}$ eventually becomes zero and the control means is then determining the $FPC_{TOTAL\text{-}OFF\ IDLE}$ value on the basis of the demand FPC look-up map values in the known manner(referring to FIG. 1(*a*) and (*b*)).

Various settings for $FPC_{INC}$ may be used depending upon desired "feel" in response to operator demand. For example, $FPC_{INC}$ may be determined by the control means such that on moving off-idle, the final $FPC_{TOTAL\text{-}OFF\ IDLE}$ value increases in a linear manner from the IDLE.INT.FPC value until it blends back into the demand FPC look-up map values in the known manner. This method ensures that the throttle response "feel" is not affected too greatly in the eyes of the operator(referring to FIG. 1(*b*)).

Alternatively, $FPC_{INC}$ may be determined such that the final $FPC_{TOTAL\text{-}OFF\ IDLE}$ value equals IDLE.INT.FPC at which point $FPC_{INC}$ is set to zero(referring to FIG. 1(*c*)). This latter alternative would provide a similar "feel" to the situation where the IDLE.INT.FPC value is used during off-idle operating mode until $FPC_{TOTAL\text{-}OFF\ IDLE}$ exceeds this value in that the operator is required to move the throttle a significant amount until the engine speed begins to increase. That is, this alternative would essentially mimic the situation in which the idle or PID controller continues to determine the FPC value until it increases beyond $FPC_{TOTAL\text{-}IDLE}$.

The control means may be sophisticated enough such that upon decelerating and approaching idle operation, the reverse may be implemented. That is, it is known that IDLE.INT.FPC was used on the previous transition from idle to off-idle operation up to a certain throttle position as determined from the throttle position sensor or pedal potentiometer as mentioned hereinbefore. Accordingly, IDLE.INT.FPC may be used from this point onwards until a closed loop idle condition is established in the known manner.

The control means may be adaptive so as to take account of changes in, for example, engine operating conditions. The control means may take into account the immediately previous duty cycle of the engine as this may warrant that the engine may need more or less fuel for nominally the same speed. That is, IDLE.INT.FPC may have been determined when the engine operating temperature was low and hence friction considerations were greater. After a certain period of operation, the engine may be substantially warmer and such friction considerations may have lessened. Accordingly, it may be suitable, for example, for $FPC_{TOTAL\text{-}IDLE}$ to be lower than IDLE.INT.FPC and so such a factor can be taken into account when determining the fuelling level to the engine during a subsequent transition between idle and off-idle operating modes.

It should be noted that such adaptability may have wider applicability than just in relation to the previously described mode of operation of the control means. For example, $FPC_{OFFSETS}$ previously determined may be accounted for during a subsequent idle/off-idle transition such that for a subsequent determination of $FPC_{TOTAL}$, $FPC_{OFFSETS}$ may essentially be zero. Such adaptability may be from journey to journey (ie. different operating events) or within a single journey (ie. during the one operating event). That is, for example, the base idle fuelling ($FPC_{IDLE\ DEMAND}$) may have some long term adaption applied thereto. If it is always necessary to add say 0.5 FPC every time an operating event ensues, it may be beneficial to do this adaptively and hence have this necessary additional fuel applied without having to repeat the learning process for each journey or operating event.

It is to be appreciated that other modes of operation for the control means may be possible. For example, the difference between $FPC_{TOTAL\text{-}OFF\ IDLE}$ and $FPC_{TOTAL\text{-}IDLE}$ may be added to all $FPC_{TOTAL\text{-}OFF\ IDLE}$ settings regardless of throttle position or engine speed.

An advantage of the method of the invention is that a fall in engine speed, for example, when engaging a gear and moving off-idle may be reduced by appropriate fuelling to the engine. That is, the demand becomes independent of engine to engine differences and variations and the engine control system can step into the demand throttle map without a drop in engine speed. Hence, the transition from idle to off-idle is essentially transparent to the operator.

The above method may be implemented using an appropriately programmed engine management system involving a microprocessor and associated circuitry in a manner as described hereinabove.

Accordingly, a further aspect of the present invention provides a control system for controlling the operation of an engine in transition between idle and off-idle operating modes comprising:

means for determining the total fuel per cycle at idle ($FPC_{TOTAL\ IDLE}$);

means for determining the total fuel per cycle off-idle ($FPC_{TOTAL\text{-}OFF\ IDLE}$);

means for comparing $FPC_{TOTAL\text{-}IDLE}$ with $FPC_{TOTAL\ OFF\text{-}IDLE}$; and means for incrementing the fuelling level to said engine by a controlled value $FPC_{INC}$ when $FPC_{TOTAL\text{-}OFF\ IDLE}$ is less than $FPC_{TOTAL\text{-}IDLE}$.

The above description of the invention is provided for the purposes of exemplification only and is not intended to place any limitation on its scope. Modifications and variations may be made without departing from the present invention.

The method of the invention may be applied in engines of all types used in marine and land applications, whether two stroke or four stroke. However, the method of the invention is especially applicable to fuelling control of two stroke direct fuel injected engines.

We claim:

1. A method of control of fuelling to an engine in transition between idle and off-idle operating modes including; determining the total fuel per cycle at idle ($FPC_{TOTAL\text{-}IDLE}$); determining the total fuel per cycle off-idle ($FPC_{TOTAL\text{-}OFF\ IDLE}$); comparing $FPC_{TOTAL\text{-}IDLE}$ with $FPC_{TOTAL\text{-}OFF\ IDLE}$; wherein if $FPC_{TOTAL\text{-}OFF\ IDLE}$ is less than $FPC_{TOTAL\text{-}IDLE}$, a control means determines a fuelling level to the engine at least greater than $FPC_{TOTAL\text{-}OFF\ IDLE}$.

2. A method as claimed in claim 1 wherein the control means determines a fuelling level to the engine by incrementing $FPC_{TOTAL\text{-}OFF\ IDLE}$ by a controlled value $FPC_{INC}$.

3. A method as claimed in claim 2 wherein $FPC_{TOTAL\text{-}OFF\ IDLE}$ is incremented by $FPC_{INC}$ before the engine leaves the idle operating mode.

4. A method as claimed in claim 1 wherein the engine is in transition from idle to off-idle operating modes.

5. A method as claimed in claim 1 wherein $FPC_{TOTAL\text{-}OFF\ IDLE}$ is set in response to operator demand ($FPC_{DEMAND}$).

6. A method as claimed in claim 5 where $FPC_{TOTAL\text{-}OFF\ IDLE}$ takes account of any fuel per cycle offsets ($FPC_{OFFSETS}$) relating to additional fuel requirements compensating for particular engine operating conditions.

7. A method as claimed in claim 2 wherein $FPC_{INC}$ is set at the difference, or a percentage of the difference, between actual $FPC_{TOTAL\ IDLE}$ and $FPC_{DEMAND}$ plus $FPC_{OFFSETS}$.

8. A method as claimed in claim 7 wherein $FPC_{INC}$ plus $FPC_{TOTAL\text{-}OFF\ IDLE}$ ($FPC_{DEMAND}$ plus $FPC_{OFFSETS}$) is at least equal to or greater than $FPC_{TOTAL\text{-}IDLE}$.

9. A method as claimed in claim 7 wherein $FPC_{INC}$ is gradually decreased in relation to increasing throttle position and/or engine speed.

10. A method as claimed in claim 9 wherein $FPC_{INC}$ is gradually reduced to zero in relation to increasing throttle position and/or engine speed.

11. A method as claimed in any claim 1 wherein $FPC_{TOTAL\text{-}OFF\ IDLE}$ is primarily calculated by a look-up table or map ($FPC_{DEMAND}$ map).

12. The method as claimed in claim 11 wherein ordinates of said $FPC_{DEMAND}$ map are throttle position and engine speed.

13. The method as claimed in claim 1 wherein $FPC_{TOTAL\text{-}IDLE}$ is in part dependent on a look-up map ($FPC_{IDLE\ DEMAND}$).

14. A method as claimed in claim 1 wherein $FPC_{INC}$ is decremented in accordance with a measured engine operating condition such that the fuelling level to the engine approaches the value of $FPC_{DEMAND}$ Plus $FPC_{OFFSETS}$.

15. A method as claimed in claim 1 wherein $FPC_{INC}$ is maintained equal to or greater than zero over the whole $FPC_{DEMAND}$ map.

16. A method as claimed in claim 1 wherein $FPC_{TOTAL\text{-}OFF\ IDLE}$ is set to $FPC_{TOTAL\text{-}IDLE}$ until $FPC_{DEMAND}$ plus $FPC_{OFFSETS}$ is greater than $FPC_{TOTAL\text{-}IDLE}$ .

17. A method as claimed in claim 1 wherein $FPC_{INC}$ plus $FPC_{TOTAL\text{-}OFF\ IDLE}$ is maintained equal to $FPC_{TOTAL\text{-}IDLE}$ until $FPC_{TOTAL\text{-}OFF\ IDLE}$ is greater than or equal to $FPC_{TOTAL\text{-}IDLE}$.

18. A method as claimed in claim 1 wherein $FPC_{TOTAL\text{-}IDLE}$ is a value IDLE.INT.FPC averaged from integrated values.

19. A method as claimed in claim 2 wherein $FPC_{INC}$ or IDLE.INT.FPC is adaptive for changes in engine operating conditions.

20. A method as claimed in claim 1 wherein $FPC_{TOTAL\text{-}IDLE}$ is a function of propeller type or propeller pitch in a marine application.

21. A method as claimed in claims 1 wherein $FPC_{TOTAL\text{-}IDLE}$ or $FPC_{OFFSETS}$ is adapted in accordance with engine operating conditions.

22. A method as claimed in claim 1 wherein said engine is a marine engine.

23. A control system for controlling the operation of an engine in transition between idle and off-idle operating modes comprising:

means for determining the total fuel per cycle at idle ($FPC_{TOTAL\text{-}IDLE}$);

means for determining the total fuel per cycle off-idle ($FPC_{TOTAL\text{-}OFF\ IDLE}$);

means for comparing $FPC_{TOTAL\text{-}IDLE}$ with $FPC_{TOTAL\text{-}OFF\ IDLE}$; and means for incrementing the fuelling level to said engine by a controlled value $FPC_{INC}$ when $FPC_{TOTAL\text{-}OFF\ IDLE}$ is less than $FPC_{TOTAL\text{-}IDLE}$.

* * * * *